United States Patent [19]

Woodward et al.

[11] 4,392,464

[45] Jul. 12, 1983

[54] CYLINDER HEAD OIL DISTRIBUTION SYSTEM FOR CERTAIN HARLEY-DAVIDSON MOTORCYCLE ENGINES

[76] Inventors: Kenneth E. Woodward, 3911 E. Weldon Ave., Phoenix, Ariz. 85018; Terry L. Zeiger, 1517 E. Dolphin, Mesa, Ariz. 85204

[21] Appl. No.: 266,802

[22] Filed: May 26, 1981

[51] Int. Cl.[3] ..... F01M 1/00

[52] U.S. Cl. ..... 123/196 R; 184/6.9

[58] Field of Search ..... 123/90.33, 90.36, 196 R; 184/6.9; 180/82, 218

[56] References Cited

PUBLICATIONS

"Cycle World", Feb. 1981, vol. 20, No. 2, p. 131.

Motorcycle Repair Manual-1972.

*Primary Examiner*—Charles J. Myhre

*Assistant Examiner*—E. Rollins Cross

*Attorney, Agent, or Firm*—Cahill, Sutton & Thomas

[57] ABSTRACT

An improved oil circulating system for lubricating engine heads of certain HARLEY DAVIDSON motorcycles includes a Y fitting connected to an oil outlet of the crankcase, a first oil tube extending from the fitting to an oil inlet of the rear head of the engine, a second tube extending from the Y connection to an oil inlet of the head of the front cylinder, and a plug for plugging an oil outlet of the head of the rear cylinder. To install the device, the original oil tube leading from the oil outlet of the crankcase to the oil inlet of the head of the rear cylinder is removed, and an oil tube leading from the oil outlet of the head of the rear cylinder to the oil inlet of the head of the front cylinder also is removed.

4 Claims, 3 Drawing Figures

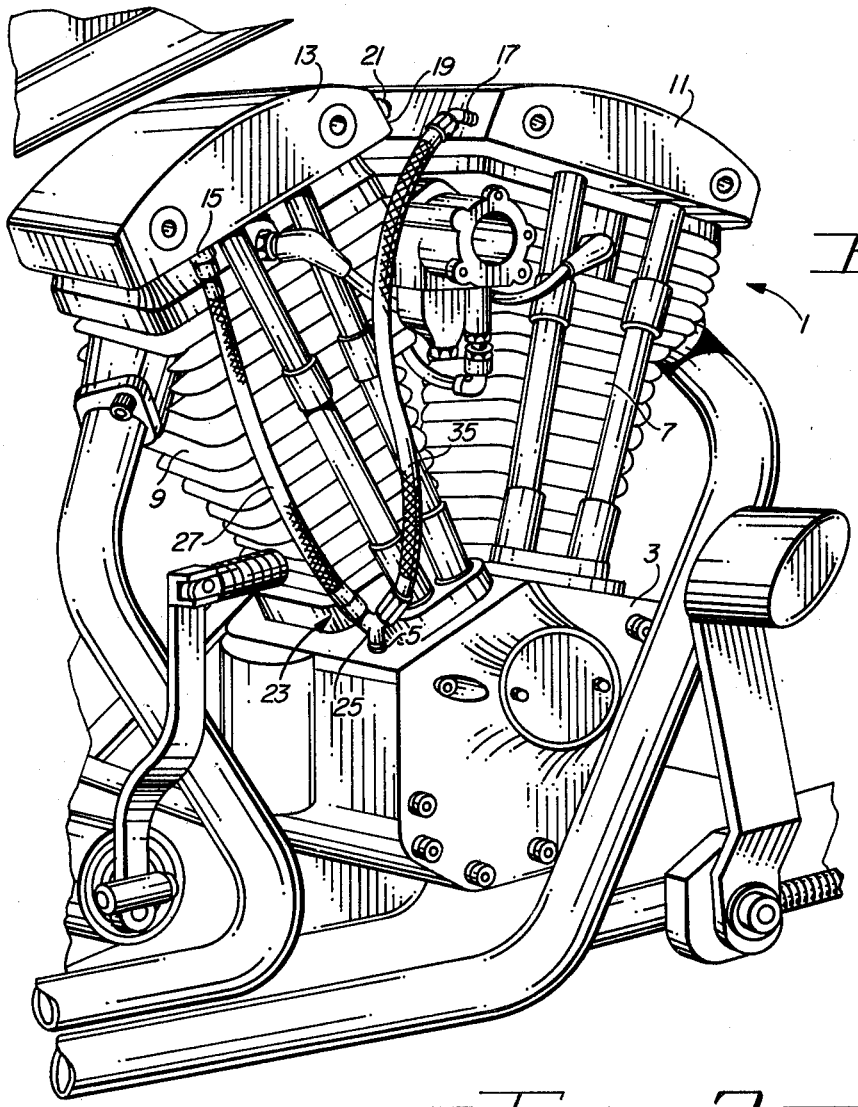
FIG. 1
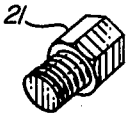
FIG. 3
FIG. 2
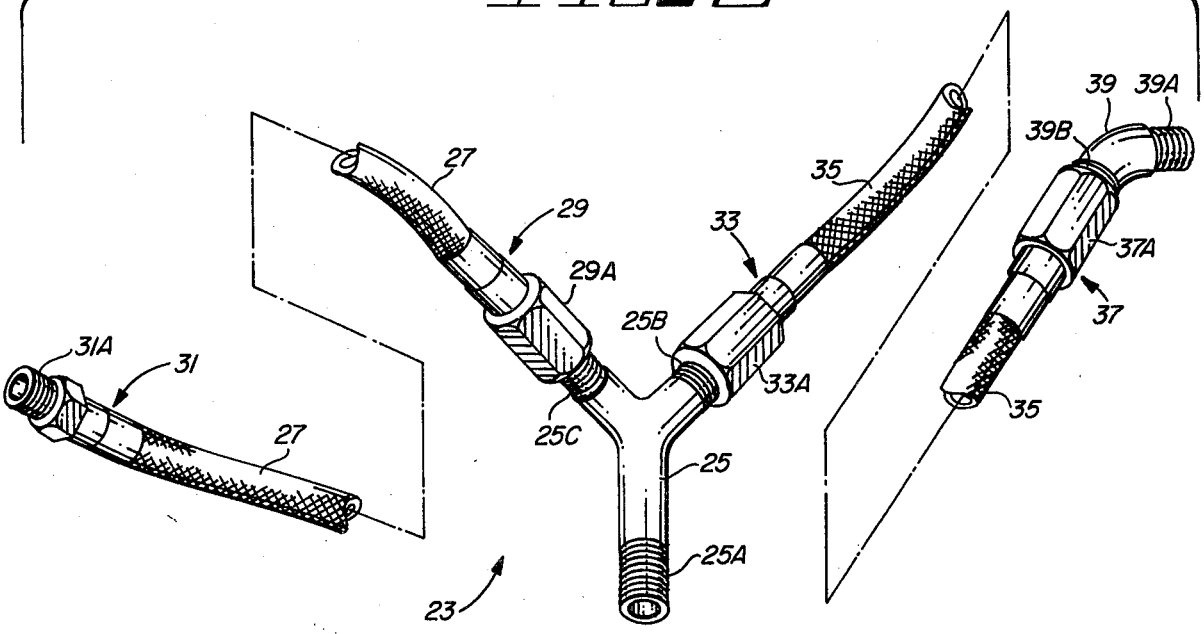

CYLINDER HEAD OIL DISTRIBUTION SYSTEM FOR CERTAIN HARLEY-DAVIDSON MOTORCYCLE ENGINES

BACKGROUND OF THE INVENTION

1. Field of the Invention

The invention relates to improved oiling systems for cylinder heads of certain HARLEY DAVIDSON motorcycle engines and methods for replacing oiling systems supplied for such engines by the manufacturer.

2. Description of the Prior Art

For many years, HARLEY DAVIDSON has manufactured twin cylinder air-cooled motorcycle engines wherein the front cylinder and rear cylinder are inclined at a 45° angle relative to each other. The engines have overhead valves. The overhead valves for the particular engines referred to have been oiled by means of a first oil tube connected to a single oil outlet located in the crankcase housing at the base of the rear cylinder and extending to an oil inlet of the head of the rear cylinder. Oil is forced through internal paths in the head of the rear cylinder. Some of the oil forced into the head of the rear cylinder returns to the crankcase, through the push rod tubes and internal return paths of that cylinder and the rest of it passes through an oil outlet of the rear cylinder head through a second tube into an oil inlet of the front cylinder head. Ordinarily, this oiling arrangement has been adequate. However, it is well known to motorcycle mechanics that the rear cylinder of such HARLEY DAVIDSON engines runs hotter than the front cylinder, (if both cylinders are adequately lubricated) because the front cylinder blocks air that would otherwise circulate through the fins of the cylinder and more effectively cool it. Consequently, the oil in the rear cylinder head is substantially heated before it reaches the front cylinder head. Under extremely high temperature engine operating conditions, the above oiling system causes the oil reaching the head of the front cylinder to be too hot to ensure adequate lubrication thereof.

Accordingly, it is an object of the invention to provide an improved oiling system which avoids undue heating of oil fed to the front cylinder head of a HARLEY DAVIDSON V-type engine having only one oil outlet in the crankcase housing.

It is quite common for HARLEY DAVIDSON motorcycle enthusiasts to customize their motorcycles often, considerably altering the original design of the motorcycles to provide radically modified appearance and to display the customized motorcycles at various shows and the like. The customized motorcycles frequently are altered also to greatly improve the mechanical operation thereof, and the ultimate objective of modification of such motorcycles as described above is to provide uniquely attractive machines having excellent mechanical performance and reliability.

It is another object of the invention to provide an attractive improved oil circulation system for cylinder heads of certain HARLEY DAVIDSON twin cylinder motor engines having overhead valves and only a single oil outlet from the crankcase thereof.

The basic design of the V-type 45° HARLEY DAVIDSON engine is very old, having been used on HARLEY DAVIDSON motorcycles since the early part of this century. Although many other manufacturers of popular motorcycles have designed vastly improved, more modern motorcycle engines, HARLEY DAVIDSON motorcycles have retained a mystique among many motorcycle enthusiasts which has been unmatched by any other brands of motorcycles. Despite various disadvantages of the above-described V-type 45° HARLEY DAVIDSON Model 74 motorcycles having the above-described engine remain highly popular, despite the fact that the engine does not incorporate certain aspects of modern motorcycle technology, including provisions by HARLEY DAVIDSON of dual oil outlet ports in the crankcase of other motorcycle engines for separate oil tubes connected to the front and rear cylinder heads. In fact, many, if not most improvements and innovations in the narrow art of HARLEY DAVIDSON V-type engines arise from the ranks of owners of such machines and mechanics who work on them, rather than from the manufacturer of HARLEY DAVIDSON motorcycles.

SUMMARY OF THE INVENTION

Briefly described, and in accordance with one embodiment thereof, the invention provides an improved oil circulation system for cylinder heads of twin cylinder V-type motorcycle engines having a single oil outlet in the crankcase thereof, the improved oiling system including a Y fitting threadably engaging the oil outlet in the crankcase and also threadably engaging first and second oil tubes, the first oil tube including a fitting threadably engaging the oil inlet of the head of the rear cylinder, and a fitting threadably engaging one outlet portion of the Y fitting. The improved oiling system also includes a second oil tube having an angled fitting threadably engaging the oil inlet on a rear side of the head of the front cylinder and another fitting threadably engaging another outlet portion of the Y fitting. The system also includes a plug threadably engaging and plugging an oil outlet on the front side of the head of the rear cylinder.

BRIEF DESCRIPTION OF THE DRAWINGS

FIG. 1 is a partial perspective view illustrating a V-type twin cylinder HARLEY DAVIDSON engine and a portion of the motorcycle on which the engine is mounted.

FIG. 2 is a partial perspective view of an improved oil distribution device installed on the engine of FIG. 1.

FIG. 3 is a perspective view of an oil plug used in conjunction with the distribution system of FIG. 2.

DESCRIPTION OF THE INVENTION

Referring now to the drawings, motorcycle engine 1 is a HARLEY DAVIDSON V-type engine having a crankcase housing 3, a front cylinder 7, and a rear cylinder 9 inclined at 45° relative to front cylinder 7. Rear cylinder 9 has an overhead valve cover 13 having a threaded oil inlet 15 disposed on the underside of head 13, as shown in FIG. 1. A threaded oil outlet 19 is disposed in the front edge of valve cover 13.

Front cylinder 7 has an overhead valve cover 11. A threaded oil inlet 17 is disposed on the rear side of valve cover 11. A single threaded oil outlet 5 is disposed in crankcase 3 near the rear portion of the base of rear cylinder 7.

Although the oil distribution system of the present invention is shown installed on the engine of FIG. 1, the previously described standard oil distribution system provided by the manufacturer provides a single tube extending between oil outlet 5 of crankcase 3 and oil inlet 15 of rear cylinder head 13 and a second oil tube extending from oil outlet 19 of rear cylinder head 13 to oil inlet 17 of front cylinder head 11. The previously mentioned finned oil cooler devices are sometimes connected in series communication with the first oil tube or the second oil tube.

In accordance with the present invention, after the stock oil distribution system has been removed, a Y type tubular fitting 25 having a threaded portion 25A is installed in crankcase oil outlet 5 so that threaded portion 25A is tightly threaded into oil outlet 5. A first tube 27 includes a steel reinforced tube portion having a flared swage fitting 29 on its lower end and a swage fitting 31 sealably connected to its upper end. A nut-type fitting 29A is included with fitting 29 and has threads which engage threaded portion 25C of one extension of Y fitting 25, so that a sealing relationship is achieved between Y fitting 25 and oil tube 27 when nut fitting 29A is tightened. It should be noted that nut fitting 29A is rotatably disposed about the swaged portion of fitting 29.

The upper swage fitting 31 has a threaded portion 31A which is threaded into oil inlet 15 of rear cylinder head 13 and tightly engaged therewith before nut fitting 29A is tightened onto threaded portion 25C during installation of the device of FIG. 2 on engine 1.

A front oil tube 35 also includes metal reinforced flexible tubing material, and has a sealably connected lower swage fitting 33 with a rotatable nut fitting 33A engaged therewith to provide a sealed relationship with Y fitting 25 when nut 33A is tightened onto threaded portion 25B of the second extension of Y fitting 25. An upper swage fitting 37 is provided on the upper end of oil tube 35, and has a rotatable nut portion 37A. An elbow connector 39 has one threaded portion 39B which mates with the threads of nut fitting 37A and a threaded portion 39A which mates with the threads of oil inlet 17 of front cylinder head 11. To install the front oil tube 35, elbow fitting 39 is first tightly installed in oil inlet 17. Then, nut fittings 37A and 33A are tightly threaded onto threaded portion 39B of elbow fitting 39 and threads 25B of Y fitting 25, respectively. To complete the installation, threaded plug 21 (FIG. 3) is tightly threaded into oil outlet 21 of rear cylinder head 13. Plug 21 can, of course, be a set screw type of plug, instead of the hex head plug shown in FIG. 3 for purposes of illustration. The hex head screw would generally be utilized and be considered more attractive.

The fittings such as 29 and 33 can be referred to as female size 4 flared base fittings, distributed by Granbery Hose & Fittings, Inc. of Phoenix, Ariz. The oil tubes are preferably one fourth inch Teflon hoses with a stainless steel braided reinforcing outer sheath, and are available from Granberry Hose & Fittings, Inc.

While the invention has been described to with reference to a particular embodiment thereof, those skilled in the art will be able to make various modifications to the disclosed embodiment of the invention without departing from the true spirit and scope thereof. For example, the nut portions 29A and 33A of fittings 29 and 33, respectively, could be permanently connected to the two upper arms of Y connector 25 instead of to oil tubes 27 and 35, and threaded fittings could be provided on the lower ends of oil tubes 27 and 35. The term cylinder "heads" as used herein is meant to include the rocker shift, rocker arms, and rocker cover commonly associated with cylinder heads.

The trademark HARLEY-DAVIDSON twin cylinder V-type motorcycle engine as used herein, together with the explanation that the engine has only a single oil outlet located in the crank case housing at the base of the rear cylinder, will very precisely identify all of the engines to which the above-described invention pertains. No other motorcycle engine, whether manufactured by HARLEY-DAVIDSON or any other firm, can be confused by those skilled in the art with the engine described in this manner.

We claim:

1. An improved oil distribution apparatus for distributing oil through the front and rear cylinder heads of a HARLEY-DAVIDSON twin cylinder V-type motorcycle engine having said front cylinder inclined at a 45° angle relative to said rear cylinder and having only a single threaded oil outlet from the crankcase thereof, said rear cylinder head having a threaded oil inlet disposed in a lower portion of said rear cylinder head, said rear cylinder head also having a threaded oil outlet disposed in a front side of said rear cylinder head, said front cylinder head having a threaded oil inlet disposed on a rear side of said front cylinder head, said apparatus comprising in combination:

(a) a tubular Y fitting means having a first tubular extension with a threaded portion for threaded sealing engagement with said crankcase oil outlet;

(b) a first oil tube external to said front and rear cylinders having an upper fitting sealably attached to an upper end thereof for threaded, sealing engagement with said oil inlet of said rear cylinder head;

(c) a first fitting for removable, sealable, connecting of the lower end of said first oil tube to a second tubular extension of said Y fitting means;

(d) a second oil tube external to said front and rear cylinders;

(e) a second fitting for removable, sealable, connecting of the lower end of said second oil tube to a third tubular extension of said Y fitting means;

(f) a third fitting for removable, sealable, connecting of the upper end of said second tube to said oil inlet of said front cylinder head; and (g) a threaded plug for sealing closed said oil outlet for said rear cylinder head.

2. The apparatus of claim 1 wherein said first tubular extension of said Y fitting means includes a threaded end portion, and said first fitting includes a nut portion rotatably disposed on said lower end of said first oil tube for threaded, sealing engagement with said threaded portion of said first tubular extension.

3. The apparatus of claim 2 wherein said second tubular extension includes a threaded portion and said second fitting includes a nut portion rotatably disposed on the lower end of said second oil tube for threaded, sealing engagement with the threaded portion of said second tubular extension, and wherein said third fitting includes a nut portion rotatably disposed on said upper end of said second oil tube for threaded, sealed engagement with an elbow fitting, said elbow fitting having a threaded portion for threaded, sealed engagement with said oil inlet of said front cylinder head.

4. The apparatus of claim 3 wherein the length of said first oil tube is approximately equal to the distance between said oil inlet of said rear cylinder head and said Y fitting means, and the length of said second oil tube is approximately equal to the distance between said Y fitting means and said oil inlet of said front cylinder head.

* * * * *